United States Patent [19]

Burgoon

[11] 4,041,567

[45] Aug. 16, 1977

[54] COMBINATION SWEEPING-SCRUBBING APPARATUS

[75] Inventor: Jack L. Burgoon, Toledo, Ohio

[73] Assignee: The Scott & Fetzer Company, Lakewood, Ohio

[21] Appl. No.: 566,980

[22] Filed: Apr. 10, 1975

[51] Int. Cl.[2] ..... A47L 11/16; A47L 11/18

[52] U.S. Cl. ..... 15/320; 15/50 C; 15/50 R; 15/83; 15/340; 15/349; 15/353; 15/366; 15/373

[58] Field of Search ..... 15/320, 340, 349, 353, 15/366, 373, 50 R, 50 C, 49 R, 49 C, 82, 83, 87

[56] References Cited

U.S. PATENT DOCUMENTS

| | | | |
|---|---|---|---|
| 2,476,526 | 7/1949 | Badlat | 15/82 X |
| 2,987,741 | 6/1961 | Feldman et al. | 15/87 X |
| 3,019,462 | 2/1962 | Nash et al. | 15/401 X |
| 3,197,798 | 8/1965 | Brown et al. | 15/320 |
| 3,701,177 | 10/1972 | Meyer et al. | 15/320 X |
| 3,833,961 | 9/1974 | Fortman et al. | 15/320 X |
| 3,879,789 | 4/1975 | Kasper | 15/320 X |
| 3,938,212 | 2/1976 | Krier et al. | 15/50 C |

*Primary Examiner*—Christopher K. Moore
*Attorney, Agent, or Firm*—Allen D. Gutchess, Jr.

[57] ABSTRACT

A machine for cleaning a surface is provided. The machine includes a forward drum brush unit designed primarily for sweeping and a rear disc brush unit designed primarily for scrubbing. Squeegees are located behind the disc brushes. Cleaning solution is supplied between the drum brush and the disc brushes and is directed toward the drum brush to achieve a wet sweeping action thereby. The disc brushes are mounted for movement toward and away from the surface to be cleaned and are engagable with the surface under controllable pressure. The drum brush is mounted on a separate frame and is engagable by the disc brush unit so that it can be raised for transportation purposes when the disc brush unit is raised. The squeegees can be raised independently of the brushes.

23 Claims, 10 Drawing Figures

COMBINATION SWEEPING-SCRUBBING APPARATUS

This invention relates to a machine for cleaning a surface by both sweeping and scrubbing in one overall operation.

A machine according to the invention has a forward sweeping unit comprising a drum brush which sweeps a surface over which the machine passes, throwing debris overhead into removable hoppers. The drum brush and hoppers are mounted on a pivotable frame so that the brush can be raised and lowered for transportation purposes. A cleaning solution supply line is located behind the drum brush, extends substantially the length thereof, and primarily supplies cleaning solution directly to the drum brush. For this purpose, a cleaning solution tank is located under an operator's seat for compactness.

A scrubbing unit is located behind the drum brush unit and includes a plurality of disc brushes extending across the machine to scrub a path substantially equal to the length of the drum brush. The disc brushes are mounted under a platform which can be raised and lowered, with the pressure of the disc brushes on the surface also being controllable. When the disc brush platform is raised, it can engage and raise the frame of the drum brush unit for transportation purposes.

A separate squeegee unit is located behind the scrubbing unit and can be separately raised and lowered. The squeegee unit preferably includes two squeegees, each with a suction hose to pick up dirty solution and supply it to two separate recovery tanks located at the sides of the machine, to the sides and rear of the operator's seat.

It is, therefore, a principal object of the invention to provide a machine capable of sweeping and scrubbing a surface in one overall operation.

Another object of the invention is to provide a machine with a sweeping unit and a scrubbing unit and to supply cleaning solution to the sweeping unit to achieve a wet sweepng operation.

A further object of the invention is to provide a sweeping-scrubbing machine which is more compact.

Yet another object of the invention is to provide a sweeping-scrubbing machine having a scrubbing unit which can be raised and lowered and a sweeping unit engagable by the scrubbing unit to be raised and lowered by same, for transportation purposes.

Yet a further object of the invention is to provide a sweeping-scrubbing machine having a drum brush for sweeping, disc brushes for scrubbing, and squeegees therebehind.

Still another object of the invention is to provide a sweeping-scrubbing machine having a sweeping brush and scrubbing brushes which are independently adjustable relative to the surface to be cleaned.

Still a further object of the invention is to provide a machine for cleaning a surface having pressure-adjusting means for adjusting the pressure of squeegees on the surface and for independently adjusting the pressure of scrubbing brushes on the surface.

Many other objects and advantages of the invention will be apparent from the following detailed description of a preferred embodiment thereof, reference being made to the accompanying drawings, in which.

Figure 1:
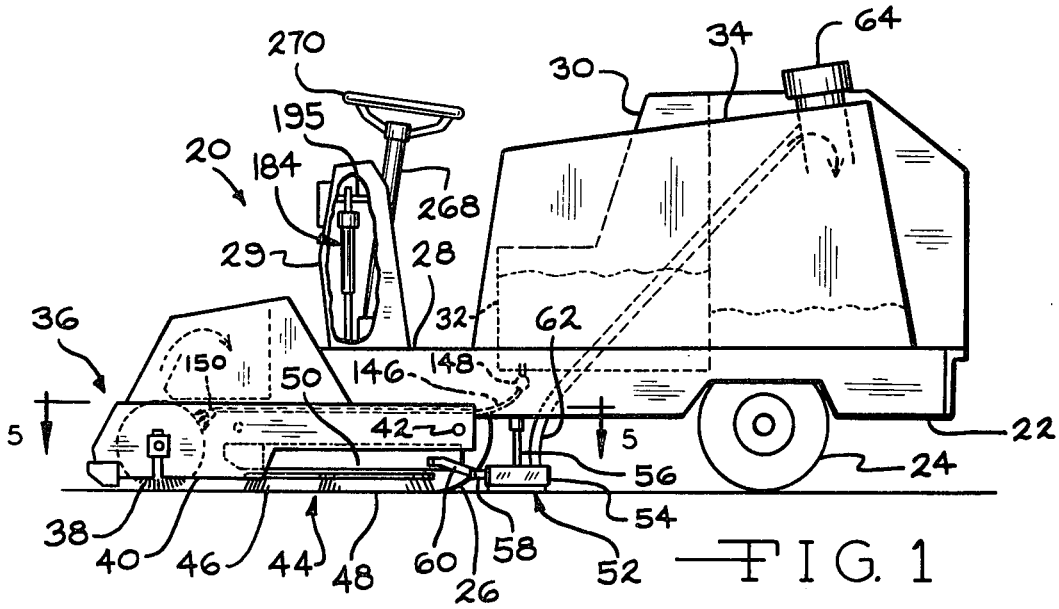
FIG. 1 is a schematic side view in elevation, with parts broken away, of a sweeping-scrubbing machine according to the invention.

Referring to FIGS. 1–4, a sweeping-scrubbing machine according to the invention is indicated at 20. The machine includes a main frame 22, a pair of rear wheels 24, and a steerable front wheel 26. A floor 28 extends across the main frame 22 and a dash stand 29 extends upwardly from the forward portion thereof. An operator's seat 30 is located rearwardly of the dash stand 29 and a cleaning solution tank 32 is located under the seat and supports same. Recovery solution tanks 34 are supported on the main frame 22 at the sides of the seat 30 and extend rearwardly thereof. A power unit is then located in the space behind the seat 30 and between the rear portions of the recovery tanks 34. This design enables the overall machine 20 to be much more compact than most surface-cleaning machines heretofore known.

The sweeping-scrubbing machine 20 includes a front sweeping unit indicated at 36. This unit basically includes a drum brush 38 and side frame members 40 which are pivotally supported by pins 42.

A scrubbing unit is indicated at 44 behind the sweeping unit 36. The scrubbing unit includes a center disc brush 46 and two outer disc brushes 48 which are supported below a platform 50.

A squeegee unit 52 is located behind the scrubbing unit 44. The unit includes two squeegees 54 supported on vertically-extending rods 56 and angularly held by pivoted links 58 and 60 (FIG. 1) connected to the sides of the platform 50. Flexible hoses 62 communicate with the squeegees 54 and extend upwardly to vacuum pumps 64 located in the tops of the recovery tanks 34 to pull dirty solution from the squeegees 54 into the tanks.

Figure 7:
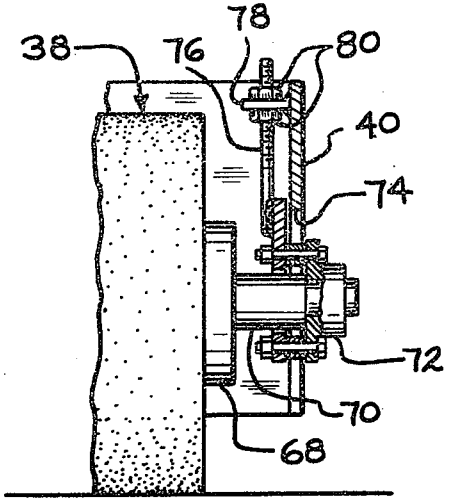
FIG. 7 is a fragmentary view in vertical cross section taken along the line 7—7 of FIG. 5.

Referring now in more detail to the sweeping unit 36, the drum brush 38 includes a multiplicity of bristles 66 (FIG. 8) extending generally radially from a hub 68. The hub has axles 70 rotatably carried in bearing blocks 72 which are adjustably mounted for vertical movement in slots 74 (FIG. 7) of the frame members 40. The bearing blocks 72 are connected to vertical threaded rods 76 extending through ears 78 in the side frame members 40 and held by nuts 80. The nuts can be turned up and down on the threaded rods 76 to move the bearing blocks 72 and the axles 70 up and down to vary the pressure and contact of the drum brush 38 with the surface to be cleaned.

Figure 8:
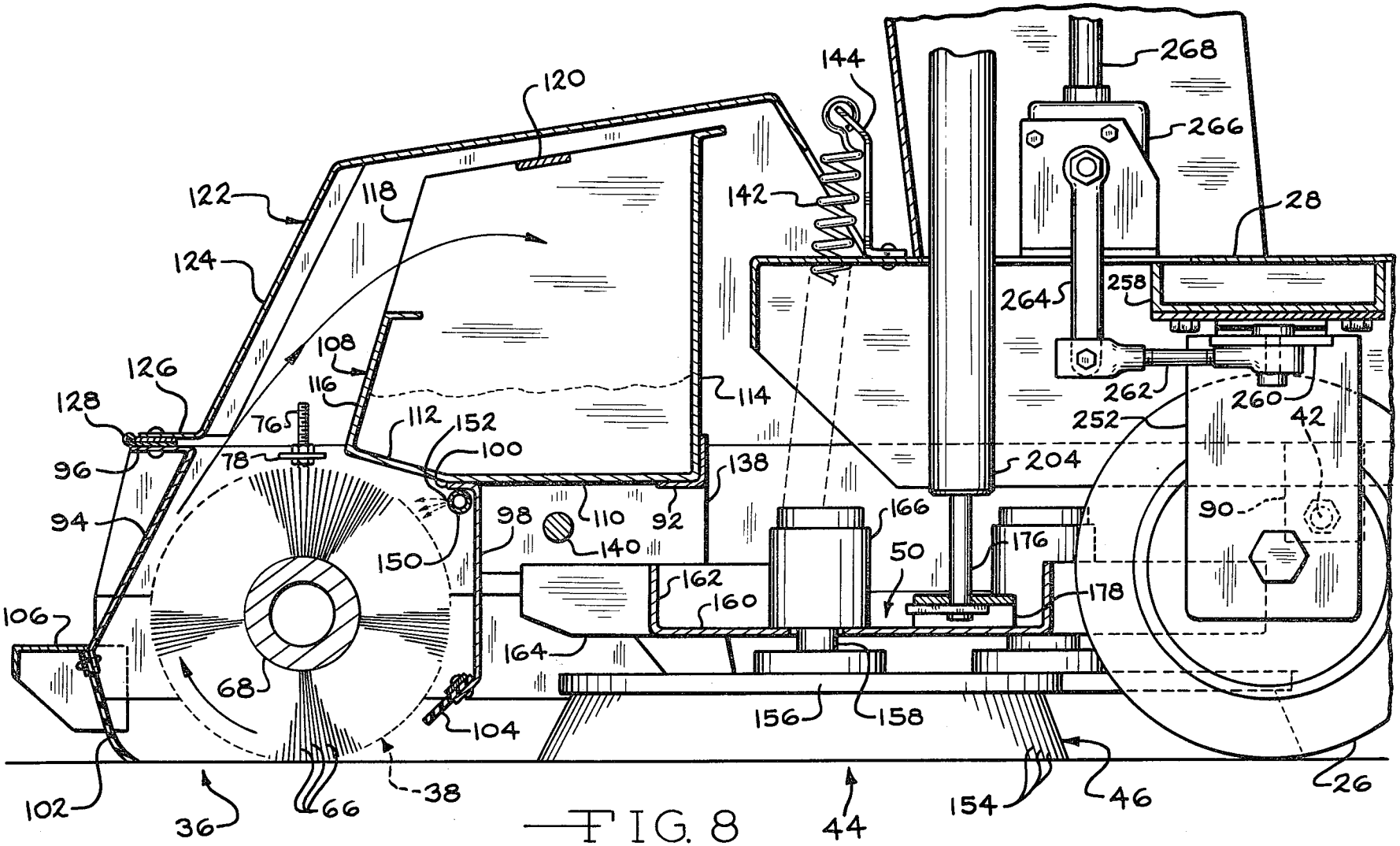
FIG. 8 is a further enlarged view in vertical, longitudinal cross section taken along the line 8—8 of FIG. 5.

The brush 38 is driven in a clockwise direction as viewed in FIG. 8 so that the bristles contacting the surface to be cleaned move in the same direction as the machine. For this purpose, the brush is driven by a hydraulic motor 82 (FIG. 5) which receives and exhausts hydraulic fluid under pressure through lines 84 and 86 which are connected to a suitable hydraulic pump at the power unit behind the seat 30 and between the tanks 34. The hydraulic motor 82 drives one of the axles 70 of the brush 38 through a chain 88 and sprockets.

The side frame members 40 of the sweeping unit 36 are pivotally supported at rear portions by the pins 42 through tabs 90 (FIG. 8) which depend from the main frame 22. Forward portions of the side frame members 40 are structurally connected by an angle bar 92 (FIG. 5 also) and by a slanted forward wall 94 having a flange 96. In addition, a partition 98 having an upper flange 100 is located immediately behind the brush 38 so that the forward slanted wall 94 and the partition 98 substantially form a housing around the brush. A forward flap 102 extends downwardly from the forward slanted wall 94 and a rear flap 104 extends downwardly from the partition 98. In front of the flap 102 is a suitable bumper strip 106.

Two debris hoppers 108 (see FIG. 2 also) are located above and to the rear of the drum brush 38, being supported on the angle bar 92 and the flange 100 of the partition 98 in side-by-side relationship. Each of the hoppers 108 includes a bottom 110 having a forward, slanted portion 112 extending forwardly of the flange 100 and serving as part of the housing for the brush 38 along with the forward wall 94 and the partition 98. The hopper also includes a back wall 114 and a short front wall 116 along with end walls 118. An opening is formed above the short front wall 116 and between the end walls 118 which receives dirt and debris thrown upwardly by the brush 38. A handle 120 extends between the end walls 118 so that an operator can pick up the hopper by the handle and empty it as needed. A cover 122 fits closely with the tops of the hoppers 108 and has a front slanted wall 124 helping to direct the dirt and debris into the hoppers. The front wall 124 has a flange 126 which is pivotally connected by a hinge 128 to the flange 96. The cover 122 is opened in a counterclockwise direction as viewed in FIG. 8 when access to the hoppers 108 is desired.

Figure 6:
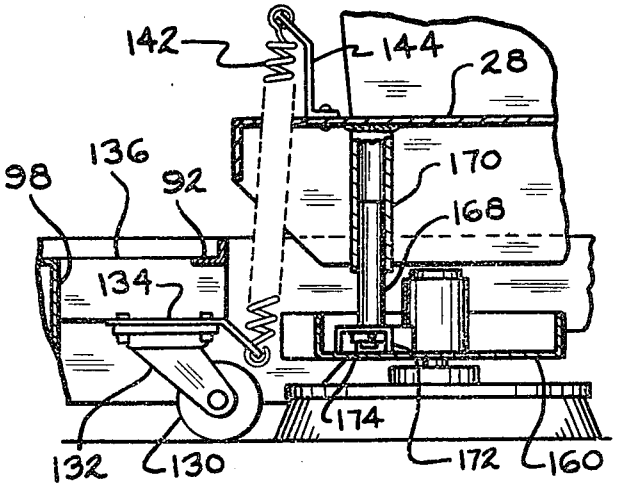
FIG. 6 is a fragmentary view in vertical cross section taken along the line 6—6 of FIG. 5.

The sweeping unit 36 also has a pair of wheels 130 (FIG. 6) rotatably suppoted by brackets 132 mounted under plates 134 to support much of the weight of the unit 36 on the surface to be cleaned. The plates 134 are connected to side plates 136 and 138 (FIG. 5) which are affixed to the angle bar 92 and the partition 100. The wheels 130 thereby support the sweeping unit and the hoppers through the side plates 136 and 138 and the members connected across the side frame members 40. The inner plates 138 are also connected by a cross bar 140 by means of which the sweeping unit 36 can be raised about the pivot pins 42, as will be discussed subsequently. Referring particularly to FIG. 6, the weight of the sweeping unit 36 is partially offset by tension coil springs 142 which are connected between the plates and upper brackets 144 which are affixed to and extend upwardly from the forward edge portion of the floor 28. The spring help to reduce the overall weight of the sweeping unit 36 and hoppers when they are raised. Nevertheless, there is still sufficient weight that the desired pressure and contact between the brush 38 and the surface to be cleaned can be achieved by adjusting the brush up or down relative to the frame members 40 and the wheels 130.

The cleaning solution is supplied in front of the scrubbing unit 44 and, in a preferred form, is applied to the drum brush 38 of the sweeping unit 36. Accordingly, cleaning solution from the tank 32 can be supplie;d through a line 146 controlled by a remotely-operated valve 148 to a supply line 150 (FIG. 8). The line 150 extends the length of the drum brush 38 and has forwardly-directed orifices 152 which direct the cleaning solution onto the bristles 66 of the brush 38. The cleaning solution thereby is distributed substantially uniformly by the brush to the surface being cleaned, only a small part of the cleaning solution being absorbed by the dirt and debris on the surface in front of the brush 38 and thrown into the hopper 108.

Figure 3:
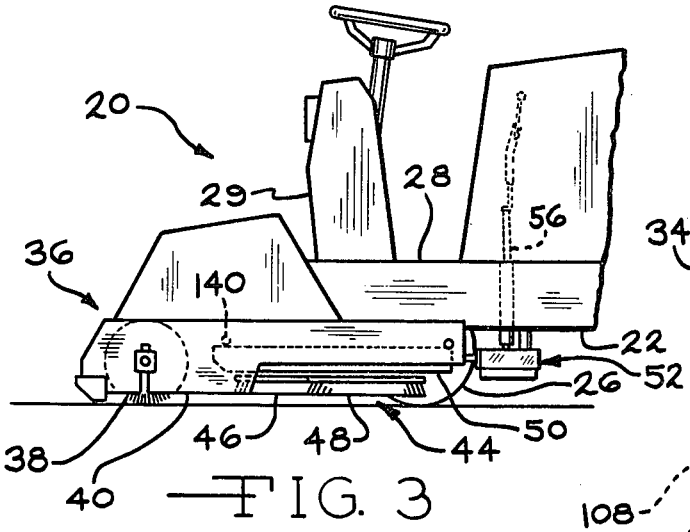
FIG. 3 is a fragmentary side view in elevation of the machine of FIG. 1 with a scrubbing unit of the machine shown in a different position.
Figure 2:
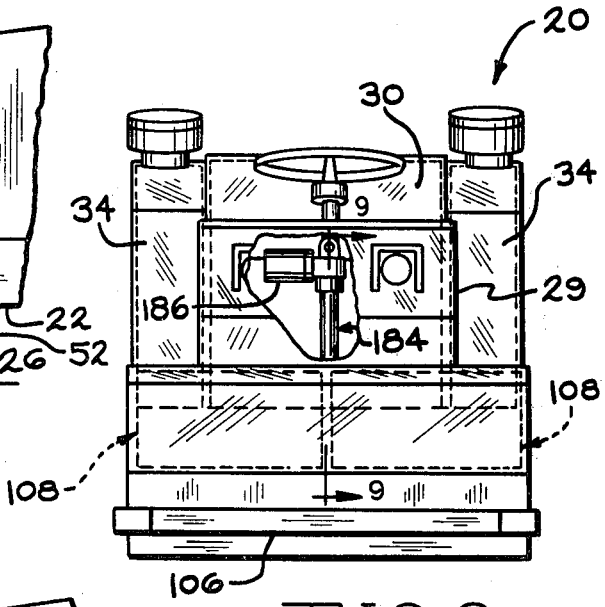
FIG. 2 is a front view in elevation, with parts broken away, of the machine of FIG. 1.
Figure 4:
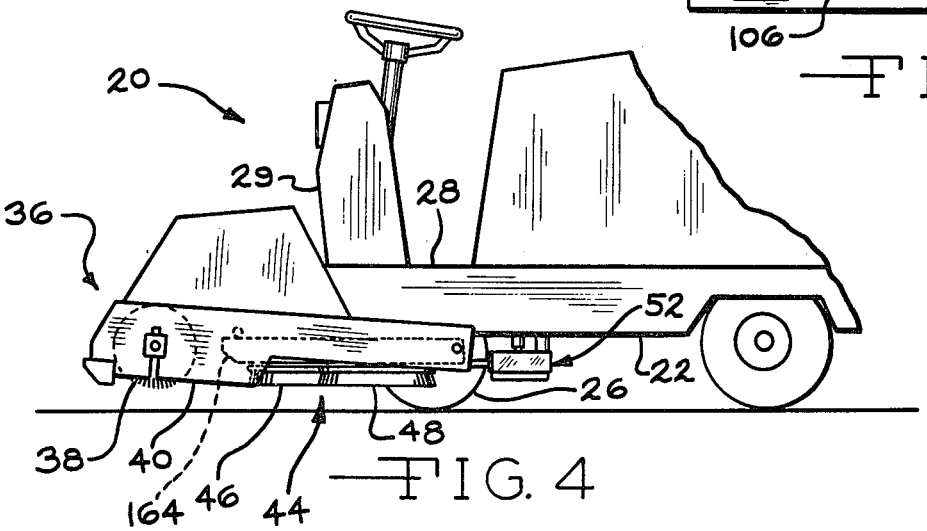
FIG. 4 is a fragmentary side view in elevation of the machine of FIG. 1 with sweeping and scrubbing units of the machine shown in different positions.
Figure 5:
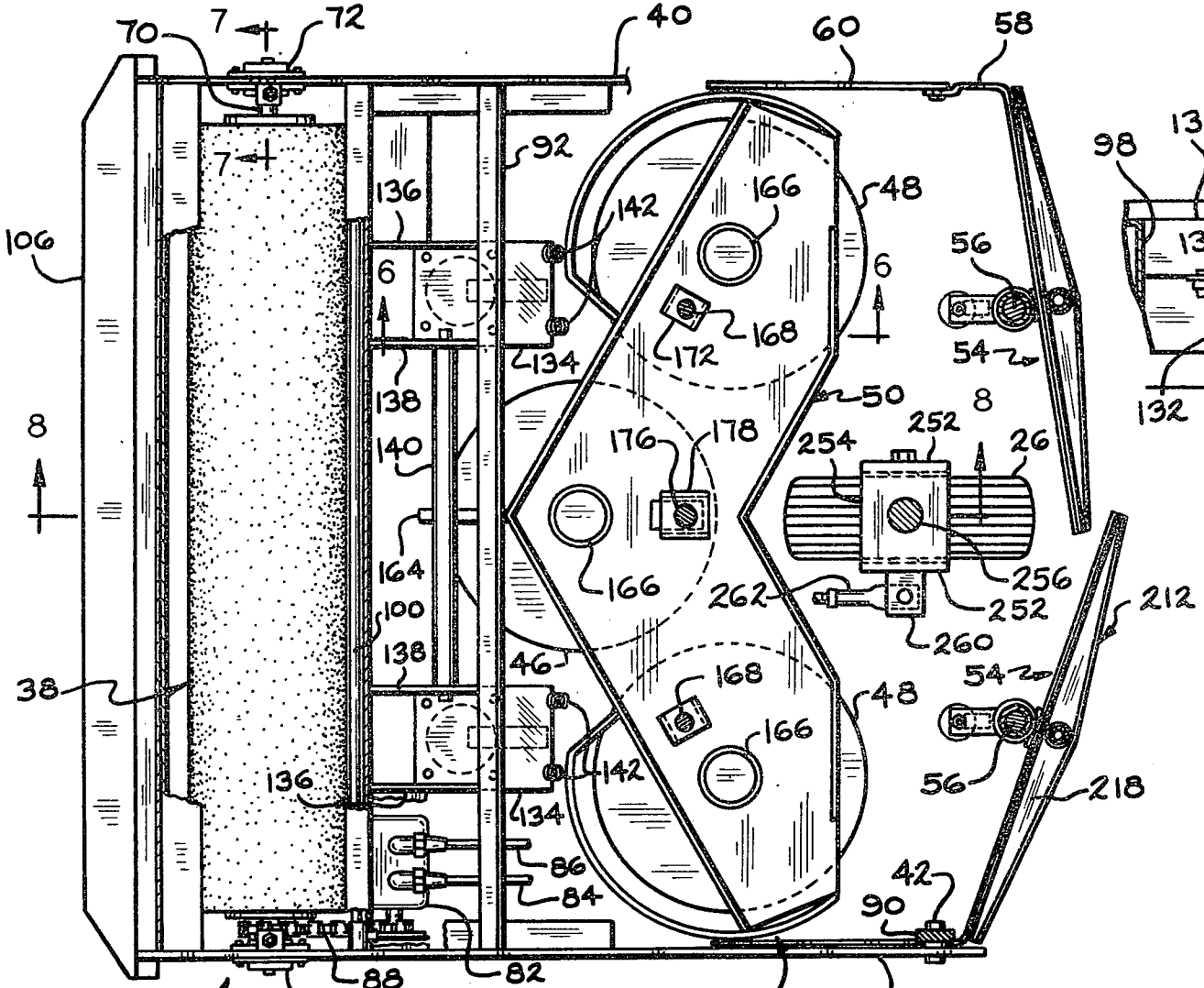
FIG. 5 is a greatly enlarged view in horizontal cross section, taken along the line 5—5 of FIG. 1, showing the sweeping unit, the scrubbing unit, and the squeegee unit of the machine.

Referring now in more detail to the scrubbing unit 44, as shown particularly in FIGS. 5 and 8, each of the disc brushes 46 and 48 includes bristles 154 extending downwardly from a circular back plate 156. A shaft 158 extends upwardly from each of the back plates 156 through the platform 50 and specifically through a deck plate 160 of the platform 50. The platform also has upwardly-extending stiffening flanges 162 at edges of the deck 160. A center ear or tab 164 extends forwardly from the platform 50 and under the bar 140 of the sweeping unit 36. With this arrangement, when the scrubbing unit 44 is raised sufficiently, as shown in FIG. 3, the tab 164 will engage the ear 140 and raise the scrubbing unit 36 about the pivot pins 42, as shown in FIG. 4.

The shafts 158 of the disc brushes are driven by hydraulic motors 166 which have supply and return lines (not shown) connecting with the same pump that drives the motor 82 for the drum brush 38. The outer two brushes 48 are preferably driven so that their leading edges toward the front of the machine engage and push cleaning solution and dirt toward the center of the machine. Thus, the upper brush 48 of FIG. 5 rotates in a counterclockwise direction and the lower brush 48 rotates in a clockwise direction. The center brush 46 can be rotated in either direction.

When the platform 50 is raised, it is guided for vertical movement and prevented from pivoting horizontally by two guide posts 168 (FIGS. 5 and 6) which are received in guide cylinders 170 depending from the floor 28. The lower ends of the guide posts 168 extend through openings in U-shaped brackets 172 with collars 174 pinned to the ends of the posts in the brackets. This connects the posts 168 to the platform 50, but enables limited movement of the posts relative to the platform.

To raise the scrubbing unit 44 and the sweeping unit 36 when the cleaning operation is completed, and to more freely transport the machine 20, a lifter rod 176 (FIGS. 5, 6, and 9) is centrally connected to the platform 50 and specifically to the deck 160 by an inverted U-shaped bracket 178 similar to the bracket 172. The rod extends through an opening the bracket 178 and is connected to a collar 180 by a pin 182 so that limited movement can also be achieved between the platform 50 and the lifter rod 176 as well as between the platform and the guide posts 168.

Figure 9:
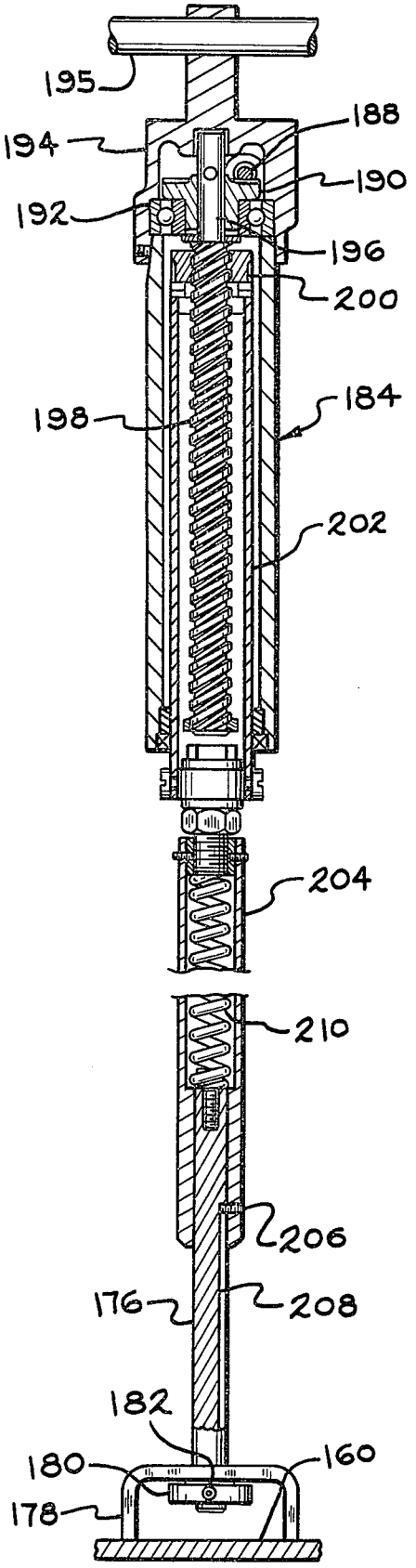
FIG. 9 is a view in vertical cross section taken along the line 9—9 of FIG. 2.

The lifter rod 176 is moved up and down by a lifter 184 (FIG. 9). The lifter 184 includes a reversible electric motor 186 (FIG. 2) which drives a spiroid worm 188. This rotates a spiroid ring gear 190 rotatably supported by a bearing 192 in a housing 194 which is carried by a supporting rod 195 in the dash stand 29. The gear 190 is affixed to a shaft 196 which rotates a screw 198. A follower nut 200 is threadedly engaged with the screw 198 and moves longitudinally of the housing 194 when the screw 198 is turned. A sleeve 202 is connected to the nut 200 and, in turn, is connected to a lower sleeve 204. The lifter rod 176 extends into the lower sleeve 204 and is held against rotation by a setscrew 206 extending into a groove 208 in the lifter rod. The sleeve 204 moves the lifter rod 176 upwardly by the cooperation of the setscrew 206 and the end of the groove 208. When the sleeve 204 is moved downwardly, the sole force exerted on the lifter rod 176 in a downward direction is by a compression spring 210 located within the sleeve 204.

When the nut 200, the sleeve 202, and the sleeve 204 are raised to the point that the screw 206 engages the end of the groove 208, the lifter rod 176 raises the scrubbing unit 44 and specifically the platform 50. This causes the tab 164 to engage the lifter bar 140 of the sweeping unit 36 and pivot it about the pins 42 after the scrubbing unit 44 reaches the position of FIG. 3. The two units then continue to be raised until reaching the position of FIG. 4. When the nut 200, the sleeve, 202, and the sleeve 204 are moved downwardly, the units move in the reverse direction until reaching the position of FIGS. 1 and 8. At this time, further movement of the sleeve 204 causes the compression spring 210 to exert pressure through the rod 176 on the scrubbing unit 44 so that a desired amount of pressure can be achieved between the disc brushes 46 and 48 and the surface to be cleaned. The sleeve 204 can be connected to a pointer on the dash stand 29 so that an operator can adjust the pressure of the disc brushes 46 and 48 on the surface by the position of the sleeve 204, as controlled by operation of the motor 186.

Figure 10:
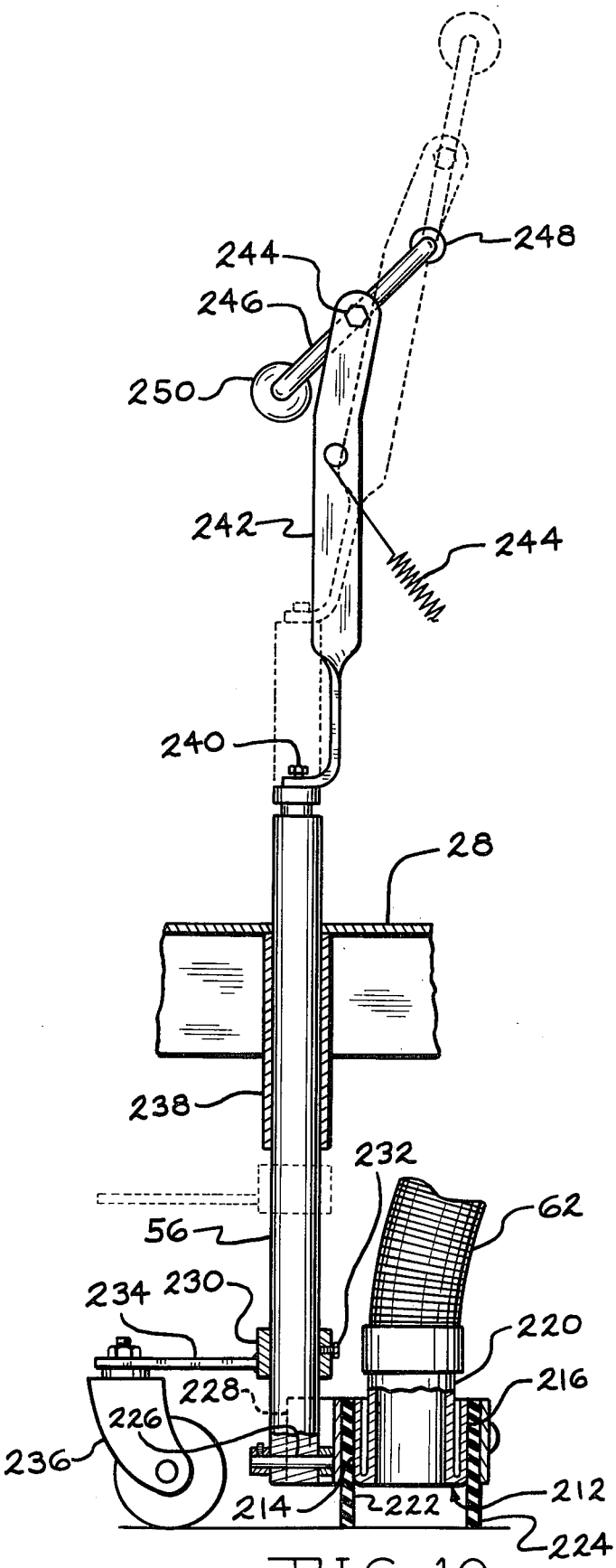
FIG. 10 is a view in vertical cross section taken through one of the squeegee components of the squeegee unit of the machine.

Referring now to the squeegee unit 52, the two squeegees 54 are positioned to cover the entire width of the path of the scrubbing disc brushes 46 and 48 so as to pick up substantially all of the cleaning solution deposited in front of those brushes through the supply line 150. The two squeegees 54 are substantially identical, but symmetrically opposite, and only one will be discussed in detail. The squeegee 54 includes a U-shaped metal core 212 (FIGS. 5 and 10) having two upright legs 214 and 216 and a lower web 218. The web 218 tapers from a maximum width at the center to a minimum width at the ends where the core 212 almost comes to a point. At the center, the core has an upright metal nipple 220 connected to the flexible exhaust line 62 which extends to the corresponding recovery tank 34.

A forward flexible squeegee blade 222 is affixed to the forwad upright leg 214 and a rear flexible blade 224 is affixed to the rear upright leg 216. The combination of the web 218 and the flexible blades 222 and 224 form a vacuum chamber communicating with the exhaust nipple 220. A central portion of the squeegee 54 is affixed to the lower end of the rod 56 by a pin 226 suitably connected to the front of the squeegee with the front also having ears 228 extending forwardly on each side of the rod 56 to limit pivotal movement of the squeegees about the pin 226 relative to the rod 56. A collar 230 is adjustably affixed to the rod 56 by a setscrew 232. The collar has a forwardly-extending ear 234 carrying a caster 236. The caster 236 contacts the surface being cleaned and controls the extent of contact or pressure of the flexible blades 222 and 224 on the surface.

The rod 56 is slidably supported in a sleeve 238 depending from the floor 28 of the machine 20. Above the floor, the upper end of the rod 56 is attached by a machine screw 240 to a link 242 which is urged downwardly by a spring 244 connected to an intermediate portion of the link, with the other end suitably connected to a part of the machine 20. The downward movement of the link 242, however, is limited by engagement of the caster 236 with the surface. The force of the spring is taken up by the caster 236 so that the contact of the blades 222 and 224 with the surface is minimized to provide controlled drag. However, the spring 244 maintains the blades in contact with the floor and improves the cleaning effect thereof on uneven or rough surfaces or surfaces having occasional protuberances.

The upper end of the link 242 is connected by a fastener 244 to an intermediate portion of a lever 246 which is pivotally supported by part of the machine 20 through a bushing 248. The opposite end of the lever 246 has a handle 250 by means of which the operator can pivot the lever in a clockwise direction to the dotted line position, which is also an overcenter position, to hold the squeegee 54 raised above the surface, as shown in FIGS. 3 and 4.

Referring to FIGS. 5 and 8, the steerable wheel 26 is located between the disc brushes 46 and 48 and the squeegees 54. The wheel 26 is rotatably carried by depending tabs 252 which are connected by a web 254 to a shaft 256. The shaft is rotatably carried by a cross box frame member 258. An arm 260 extends to one side of the web 254 and is connected to a horizontal steering link 262. This link is connected to a vertical steering arm 264 which is pivoted back and forth as viewed in FIG. 8 by a gear box 266. The gear box 266 is connected to a steering shaft 268 which terminates in a steering wheel 270, as shown in FIG. 1. To aid in steering the machine 20, because the surface with which the wheel 26 is in contact may be slippery, each of the rear wheels 24 can have a brake which can be individually applied to aid the steering.

Various modifications of the above-described embodiment of the invention will be apparent to those skilled in the art and it is to be understood that such modifications can be made without departing from the scope of the invention, if they are within the spirit and the tenor of the accompanying claims.

I claim:

1. A machine for cleaning a surface comprising a frame, wheel means including a steerable wheel for supporting said frame above the surface, a cleaning solution tank carried by said frame, a recovery solution tank carried by said frame, a drum brush mounted below said frame for contacting the surface and for removing debris thereon, means on said frame near said drum brush for receiving debris therefrom, a supply line for supplying cleaning solution from said cleaning solution tank to said drum brush so that said drum brush distributes cleaning solution to the surface in addition to removing debris therefrom, means for rotating said drum brush, at least on disc brush located behind said drum brush for scrubbing the surface with the cleaning solution distributed by said drum brush after the debris is removed, means for rotating said disc brush, surface-engaging means located behind said disc brush for collecting cleaning solution deposited on the surface from said supply line, and exhaust means having passage means with one end located near said surface-engaging means to carry the collected solution from the surface to said recovery solution tank.

2. A machine according to claim 1 characterized by said drum brush being pivotally connected to said frame for movement toward and away from the surface.

3. A machine according to claim 1 characterized by means for moving said disc brush toward and away from the surface.

4. A machine according to claim 3 characterized by said disc brush being part of a rear sweeping unit and said drum brush being part of a front sweeping unit, and means connectible between said disc brush unit and said drum brush unit for raising said drum brush when said disc brush is raised.

5. A machine according to claim 1 characterized by there being two of said recovery solution tanks carried by said frame and said surface-engaging means comprises two squeegees located behind the disc brush, with each squeegee connected by said exhaust means to one of said recovery solution tanks.

6. A machine according to claim 1 characterized by a removable hopper positioned above said drum brush for receiving dirt and debris threfrom.

7. A machine according to claim 1 characterized by said drum brush being mounted below said frame by frame members pivotally carried by said frame whereby said drum brush can be pivoted for movement toward and away from the surface, means connected to said disc brush and extending above said frame for raising and lowering said disc brush, and means connected to said surface-engaging means and extending above said frame for raising and lowering said surface-engaging means relative to the surface.

8. A machine according to claim 7 characterized by means for changing the pressure of said drum brush on the surface, said means for raising and lowering said disc brush including means for changing the pressure of said disc brush on the surface.

9. A machine according to claim 7 characterized by means connectible between said disc brush and said frame members for raising said drum brush when said disc brush is raised.

10. A machine according to claim 1 characterized by said supply line for supplying cleaning solution to said drum brush extending substantially the length of said drum brush and having orifices therealong for directing cleaning solution toward said drum brush.

11. A machine for cleaning a surface comprising a main frame, wheels for supporting said frame above the surface, a cleaning solution tank carried by said frame, at least one recovery solution tank posiitoned on said frame, a drum brush mounted below said frame for contacting the surface and for removing debris thereon and for distributing a cleaning solution on the surface, means on said frame near said drum brush for receiving debris therefrom, means for rotating said drum brush, a supply line for supplying cleaning solution from said cleaning solution tank for distribution on the surface by said drum brush, disc brush means located behind said drum brush, said disc brush means being effective to scrub a path of the surface having a width at least substantailly equal to the length of said drum, means for rotating said disc brush means, squeegee means located behind said disc brush means to gather the cleaning solution at a central point, and exhaust means for carrying the solution from the surface to said recovery solution tank.

12. A machine according to claim 11 characterized by said squeegee means comprises two squeegees in side-by-side relationship, each of said squeegees having passage means communicating with said exhaust means to move the solution from one of said squeegees to a corresponding one of said recovery solution tanks.

13. A machine for cleaning a surface according to claim 11 characterized by a pivotable frame pivotally supported by said main frame, and means for rotatably supporting said drum brush by said pivotable frame.

14. A machine for cleaning a surface according to claim 13 characterized by said debris receiving means being a removable hopper carried by said pivotable frame above said drum brush to receive debris removed from the surface by said drum brush.

15. A machine according to claim 14 characterized by there being two of said removable hoppers in side-by-side relationship.

16. A machine according to claim 14 characterized by a pivotable cover carried by said pivotable frame and movable from a position over said hopper, to help direct debris from said drum brush to said hopper, to a position spaced from said hopper, to enable removal of said hopper.

17. A machine according to claim 13 characterized by means for raising said disc brush means, and means connectible between said disc brush and said pivotable frame for raising said pivotable frame and said drum brush means when said disc brush is raised.

18. A machine according to claim 13 characterized by wheel means carried by said pivotable frame and engagable with the surface.

19. A machine according to claim 13 characterized by resilient means connected to said pivotable frame for urging said pivotable frame away from the surface.

20. Apparatus according to claim 11 characterized by means connected to said disc brush means and extending above said frame for raising and lowering said disc brush means.

21. A machine according to claim 11 characterized by said supply line supplying cleaning solution from said cleaning solution tank to said drum brush and then to the surface.

22. A machine according to claim 11 characterized by said disc brush means comprising three disc brushes located behind said drum brush and covering a path having a width substantially equal to the length of said drum brush, with the outer two disc brushes rotated in opposite directions with their forward edges moving toward the center of the machine.

23. A machine according to claim 11 characterized by means for moving said disc brush means toward and away from the surface and having means including spring means for changing the pressure of said disc brush on the surface.

* * * * *

UNITED STATES PATENT OFFICE

CERTIFICATE OF CORRECTION

PATENT NO. : 4,041,567

DATED : August 16, 1977

INVENTOR(S) : Jack L. Burgoon

It is certified that error appears in the above-identified patent and that said Letters Patent are hereby corrected as shown below:

Column 4, line 14, for "hopper" substitute --hoppers--

Column 5, line 20, after "sleeve" delete --,--.

Column 6, line 59, for "on" substitute --one--.

Column 7, line 19, after "by" insert --said debris-receiving means being--.

Line 49, change "posiitoned" to --positioned

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*